United States Patent [19]

Dunk

[11] Patent Number: 4,562,718

[45] Date of Patent: Jan. 7, 1986

[54] PALLET AND METHOD OF PRODUCTION

[75] Inventor: Robert J. Dunk, Beverley, Australia

[73] Assignee: Precision Tool & Gauge Pty. Ltd., Beverly, Australia

[21] Appl. No.: 587,480

[22] Filed: Mar. 8, 1984

[30] Foreign Application Priority Data

Mar. 11, 1983 [AU] Australia ..... PF8401

[51] Int. Cl.[4] ..... B21D 22/26

[52] U.S. Cl. ..... 72/349; 72/379; 108/53.3

[58] Field of Search ..... 108/51.1, 53.1, 53.3, 108/53.5; 72/348, 349, 379

[56] References Cited

U.S. PATENT DOCUMENTS

| | | | |
|---|---|---|---|
| 2,872,887 | 2/1959 | Praturlon | 72/349 |
| 3,194,047 | 7/1965 | Eggert, Jr. et al. | 72/349 |
| 3,545,249 | 12/1970 | Brown | 72/379 |
| 3,707,127 | 12/1972 | Palfy | 108/53.3 |

FOREIGN PATENT DOCUMENTS

| | | | |
|---|---|---|---|
| 807571 | 1/1959 | United Kingdom | 108/53.1 |

*Primary Examiner*—Lowell A. Larson

*Attorney, Agent, or Firm*—Townsend and Townsend

[57] ABSTRACT

A sheet metal workpiece is formed to have a plurality of relatively large diameter but relatively shallow cup-like depressions in a first draw operation, to have the shapes of the cup-like depressions changed in a subsequent draw operation and to form the base of the central cup-like depression into a secondary cup-like depression in a further draw operation.

5 Claims, 6 Drawing Figures

PALLET AND METHOD OF PRODUCTION

This invention relates to a pallet formed from sheet metal, and to a method of production thereof.

BACKGROUND OF THE INVENTION

Pallets are currently constructed by a fabricating process to have upper and lower platforms and blocks or beams therebetween, enabling a forklift truck to position its forks within or beneath the pallet on at least two sides, preferably four sides. However the production methods are expensive, the costs of the pallets are high and the likelihood of damage is also high, and accordingly it has been proposed heretofore to arrange a pallet to be formed from plastics material, formed for example by a drape moulding process, to have a plurality of cup-like portions which can rest upon the ground but raise a platform area above the ground. Such pallets are however subject to a number of disabilities. Firstly, plastics material is not sufficiently rugged to withstand general usage unless very expensive reinforced resins are used. Secondly, there is usually an area near the centre of the platform of the pallet which is likely to deflect upon a load being imparted. Thirdly, the cost is high if the material thickness and resin type is sufficient to provide even moderate strength.

Because of the high cost of fabricating steel pallets, use is still made mostly of wooden pallets, and the main object of this invention is to provide improvements in pallets, and also in their method of production, whereby steel or other sheet metal may be used.

In the pressing of steel there are two recognised functions, one known as "metal flow" wherein metal can flow from around an area in which a cup-like depression is to be formed, so as to form the cup-like depression and the second is known as a "metal stretch" wherein the metal is actually elongated and attenuated in thickness. It is also known to form a comparatively deep cup-like depression by firstly forming a shallow cup-like depression with predominately a metal flow process and only a small amount of metal stretch, and subsequently reducing diameter but increasing depth again with mostly a metal flow process. This arrangement would be satisfactory for example for forming a plurality of supports near the periphery of a pallet, but is completely unsuitable for forming a central cup-like depression, but a central support is usually required for a pallet. The reason for this is that when the peripheral cup-like depressions are formed, the metal flows from all directions to form those depressions, including from the centre of the pallet platform, but metal flow in a reverse direction is required to form a central depression. It will be appreciated that, in order to ensure a pallet is universally usable, it must accept not only the forks of a forklift truck but also the forks of a hand truck, and consequently a depth of about 95 mm is required.

Because of the abovementioned difficulties it has heretofore been considered not practicable to form a shape similar to what is required to provide not only peripheral supports but also a central support for the platform.

BRIEF SUMMARY OF THE INVENTION

The main object of this invention is to overcome the abovementioned difficulties so that a pallet can be formed from a single sheet of metal having deep draw qualities, without the need to fabricate, and in one embodiment of this invention a sheet metal workpiece is formed to have a plurality of relatively large diameter but relatively shallow cup-like depressions in a first draw operation, to have the shapes of the cup-like depressions changed in a subsequent draw operation and to form the base of the central cup-like depression into a secondary cup-like depression in a further draw operation.

More specifically, in one embodiment the invention consists of pressing a planar sheet metal workpiece in a first draw operation in a press so as to form a cup-like central depression and eight cup-like peripheral depressions, all of circular shape in plan and all having bases of curved cross-sectional shape, the depressions being in a symmetrical pattern, subjecting the workpiece to a further draw operation in a press so as to further form all said depressions to a greater depth and smaller diametric, and each with a discoid end, the peripheral depressions all having the same depth, but the central depression having a lesser depth, and subjecting the workpiece to a still further draw operation so as to form a minor depression in the discoid end of the central depression, such that all depressions have the same depth.

When pallets are transported from place to place it is desirable that they should occupy as little volume as possible, but on the other hand they must not be so closely spaced that it is difficult to separate them. Furthermore, the loading which is imparted to a platform might vary considerably over the area of the platform, and it is clearly desirable that the platform should be as stiff as possible. In another embodiment of this invention, a plurality of ribs extend across the face of the platform area of the pallet, some at least of the ribs terminating at their ends in the walls of the depressions.

BRIEF DESCRIPTION OF THE DRAWINGS

An embodiment of the invention is described hereunder in some detail with reference to, and is illustrated in, the accompanying drawings, in which.

In this embodiment a pallet 8 is formed to have a platform portion, and three rows of cup-like depressions forming feet for the platform portion, there being three depressions in each row.

The forming is a press operation which includes the following stages:

FIRST DRAW

Figure 1:
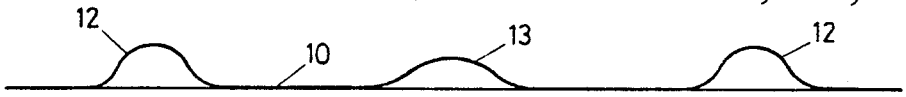
FIG. 1 illustrates diagrammatically the central cross-sectional shape of a sheet metal workpiece after having been subjected to a first draw operation in a press.

FIG. 1 illustrates a first draw operation wherein a square sheet 10 of low carbon steel is drawn to have four corner peripheral depressions 11, four intermediate peripheral depressions 12 and one central depression 13. Each of the four corner depressions 11 and the intermediate depressions 12 is formed to a depth of a little less than three-quarters of the final depth, and to a diameter between two and three times the depth (about 200 mm diameter by 79 mm deep). The draw angle is about 25 degrees (50 degrees included angle), so that the initial draw causes the corner and peripheral depressions to be large diameter shallow depressions. The danger of metal split is reduced by having the depression bases of mostly curved cross-sectional shape as shown in FIG. 1.

The central depression 13 however causes great difficulty in that there is very little metal available for drawing, much of the metal otherwise available having been drawn into the intermediate peripheral depressions 12. Accordingly the central depression 13 is made larger in diameter and shallower in depth (about 230 mm diameter by 71 mm deep), and also with a wider draw angle, again in this embodiment about 30 degrees (60 degrees included angle). Although obviously there is some drawing of the metal both from the central portion of the central depression and from the surrounding metal, most of the wall extension will be due to a stretch rather than a draw of the metal. This of course strains the metal and limits subsequent stretching.

SECOND DRAW

Figure 2:
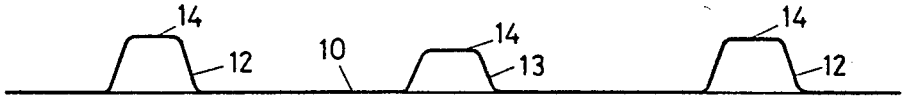
FIG. 2 illustrates diagrammatically the central cross-sectional shape of a sheet metal workpiece after having been subjected to a second draw operation.

The second draw, or redraw, is illustrated in FIG. 2 and performs the function on the peripheral depressions 11 and 12 of changing the shape in each instance from a wide shallow depression to a narrower deeper depression (about 150 mm diameter by 95 mm deep) and this is effected mostly by a redraw of the metal, in accordance with art which is already known. In the redraw, the draw angle is reduced.

In the case of the central depression 13 however additional depth is required above that which can be achieved by redrawing, particularly having regard to the initial stretch of the walls of the depression. Some drawing takes place in the second draw (when the diameter is reduced from 230 mm to 175 mm and the depth increased from 71 mm to 86 mm). The ends of the peripheral depressions are formed to discoid shape 14 in the second draw, and the end of the central depression is at least partly flattened.

THIRD DRAW

Figure 3:
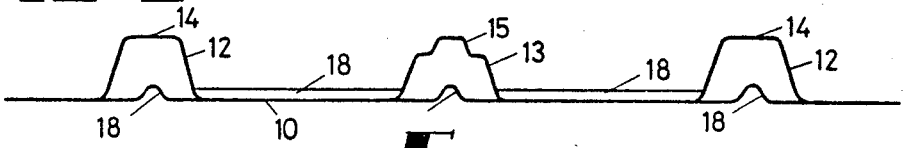
FIG. 3 illustrates diagrammatically the central cross-sectional shape of a sheet metal workpiece after having been subjected to a third draw operation.
Figure 4:
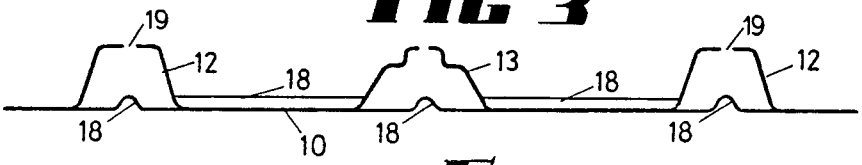
FIG. 4 illustrates diagrammatically the central cross-sectional shape of a sheet metal workpiece after having been subjected to a trim and pierce operation.

The metal available for metal flow is insufficient to obtain the required full depth of the central depression 13, and this is achieved by separately forming a minor depression 15 in its discoid end 14, in the third draw illustrated in FIG. 3. Although the discoid end will have been partly stretched and the metal will have been reduced in thickness by the first operation, a central part of the discoid end is metal which has not been excessively strained and this is stretched to provide the minor depression 15, which in use becomes a smaller diameter foot. By this means the central depression can be carried to the same depth as the peripheral depressions. At the same time the peripheral depressions 11 and 12 are slightly increased in depth (from 95 mm to 98 mm).

Figure 5:
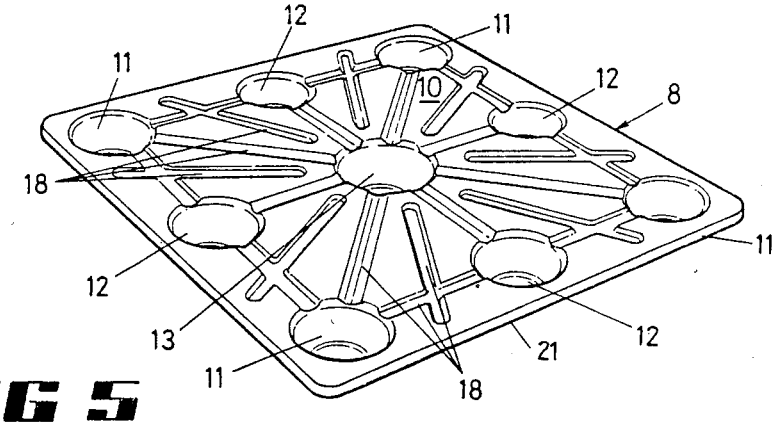
FIG. 5 is a perspective view of a pallet after a pressing operation which forms ribs and wipes the workpiece periphery edge to form a downturned flange.
Figure 6:
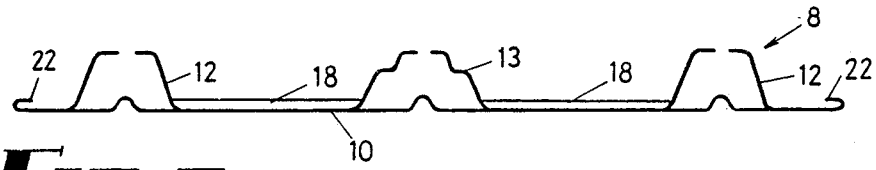
FIG. 6 illustrates the final operation, that of curling the flange to form a curled edge.

During the third draw, a first group of ribs of a pattern of ribs 18 are formed in the planar part of the sheet 10. The entire pattern of ribs is illustrated in FIG. 5, and those of the ribs formed during the third draw are all those which do not radiate from the central depression, that is, the ribs which extend between the peripheral depressions 11 and 12, and those short intermediate ribs which intersect them.

Trim and Pierce

In the drawing operation, as would be expected the metal around the periphery is drawn inwardly at the locality of the peripheral depressions 11 and 12. The sheet 10 is trimmed by a die guillotine operation, and at the same time the discoid ends of the depressions are all pierced to provide drainage holes 19.

Flange and Rib formation

The remainder of the ribs 18 are formed in the sheet 10, these being the ribs radiating outwardly from the central depression 13 to the peripheral depressions 11 and 12. At the same time, an initial wiping operation forms a peripheral flange 21.

Curl edge

The pallet is then placed in a curling die and the flange 21 is curled downwardly and inwardly to form a curled edge 22, so as to avoid the danger of a raw edge being encountered by fingers of an operator when handling the finished pallet. Furthermore, the downwardly curled edge can be formed to about the same depth as the ribs, so that when the forks of a forklift truck or hand truck enter between the depressions, they support the platform area at a plurality of points. If the pallet is made square, the truck can come in from any one of its four sides.

Die construction

Heretofore, when metal is to be formed either by a stretching or by a metal flow process in a press, it has been customary for the metal to be "contained" between adjacent surfaces. However this imparts certain limitations on accuracy and tolerance of operation of the press and the dies, and these limitations are avoided in this invention wherein the female die surrounds the male die with a relatively wide clearance, deforming the metal continuously as it wipes the outer surface of the frustum of the depression, and at the same time both stretching and flowing the metal to the new shape. In the case of the central depression, the metal is stretched between the projecting portion of the male die and its shoulder, but the discoid portion is resized during the wipe and rib formation.

Contrary to expectations, it has been found that an effective pallet can be formed without excessive wrinkles and with minimum danger of shearing of metal, by utilising the process of this invention. The pallet is of lower cost than pallets made from metal previously, it is more easily stacked, and is lighter in weight. There is a minimum of hazard to an operator in that the sharp edges which may be encountered by his fingers are those of an inwardly formed curled edge. The platform is inherently stiff because of the lattice work of the stiffening ribs formed in the pallet.

I claim:

1. A method of pallet production, comprising pressing a planar sheet metal workpiece in a first draw operation in a press so as to form a cup-like central depression and eight cup-like peripheral depressions, all of generally circular shape in plan and all having bases at least portions of which are of curved cross-sectional shape, the depressions being in a symmetrical pattern, the eight cup-like peripheral depressions being of identical shape and size, but the central depression being of larger diameter and less depth than any of the peripheral depressions, subjecting the workpiece to a further draw operation in a press so as to further form all said depressions to a greater depth and smaller diameter, and a discoid end in each of the peripheral depressions, and at least partly flattening the end of the central depression, said further draw operation forming the peripheral depressions to approximately the same depth, but the central depression to a lesser depth, and subjecting the workpiece to a still further draw operation so as to form a minor depression in the end of the central depression only, such that all depressions then have the same depth.

2. A method according to claim 1 further comprising deepening the peripheral depressions simultaneously with said forming of a minor depression in the end of the central depression.

3. A method according to claim 1 further comprising forming a first group of ribs in the workpiece simultaneously with forming said minor depression in the end of the central depression, said first group of ribs extending between the peripheral depressions and terminating in the walls thereof.

4. A method according to claim 3 further comprising trimming the edge of the metal by a trim action, piercing the discoid ends of the depressions, and, in a further operation, forming a second group of ribs radiating outwardly from the central depression to respective peripheral depressions, and terminating at their ends in the walls of said depressions, while simultaneously forming a peripheral flange in that said further operation.

5. A method according to claim 4 further comprising in a still further operation, curling the edge of the peripheral flange.

* * * * *